United States Patent [19]

Müller et al.

[11] Patent Number: 4,967,898

[45] Date of Patent: Nov. 6, 1990

[54] CONVEYOR APPARATUS FOR THE TRANSPORT OF SHEET METAL BLANKS

[75] Inventors: Jakob Müller, Enges; Peter Schreiber, Ipsach, both of Switzerland

[73] Assignee: Fael S.A., Saint-Blaise, Switzerland

[21] Appl. No.: 360,538

[22] Filed: Jun. 2, 1989

[51] Int. Cl.[5] ..... B65G 15/00

[52] U.S. Cl. ..... 198/404; 414/788.5; 414/791; 414/794.7; 198/418.3

[58] Field of Search ..... 414/788.4, 788.5, 789.6, 414/791, 794.7, 761, 773; 198/403, 404, 418.3, 418.1, 418.2, 744, 746; 270/58

[56] References Cited

U.S. PATENT DOCUMENTS

| | | | |
|---|---|---|---|
| 1,567,153 | 12/1925 | Kelly | 198/404 X |
| 1,717,430 | 6/1929 | Young et al. | 198/418.3 |
| 3,191,919 | 6/1965 | Acker | 198/746 X |
| 3,888,344 | 6/1975 | Major | 198/746 X |
| 4,645,400 | 2/1987 | Mally et al. | 198/404 X |
| 4,801,036 | 1/1989 | Rathert | 198/418.3 |

FOREIGN PATENT DOCUMENTS

| | | | |
|---|---|---|---|
| 1001036 | 8/1965 | United Kingdom | 198/418.3 |

*Primary Examiner*—Robert J. Spar
*Assistant Examiner*—Cheryl L. Gastineau
*Attorney, Agent, or Firm*—Laurence R. Brown

[57] ABSTRACT

The conveyor apparatus is connecting a cutter, by means of which sheet metal blanks are produced in adjacent rows, to the magazine of a can welding apparatus which produces from the sheet metal blanks can bodies. A row of adjacently arranged depositing receptacles for receipt of at least one sheet metal blank each is located along the cutter on a frame. Two conveyor chains having dogs move along the depositing receptacles of which each presents a bottom surface which rises in the direction of transport such that the dogs push the sheet metal blanks from one to the next depositing receptacle and accordingly collect the sheet metal blanks out of all depositing receptacles such to form a pile at the end. Such pile is taken over at the end of the path of transport of the conveyer chains by a further conveyer means in form of elastically supported pawls. These pawls push the pile on a slanted rising slideway in a timed fashion by a certain span of the path of transport and are moved oscillatingly and are pressed under the pile during their reverse movement. By means of the pawls the staple is moved into a turn-over apparatus which includes two disk wheels which move rotatingly in slots in the slideway after a respective pile of sheet metal blanks has been pushed into radially extending slots in the two disk wheels. After a rotation of 180° each pile has been turned over and is transported on the adjoining slideway by further pawls, of which a plurality is provided along the slideway, into the magazine. The turn-over apparatus is only facultatively present for the case that printed sheet metal blanks must be turned over.

2 Claims, 1 Drawing Sheet

CONVEYOR APPARATUS FOR THE TRANSPORT OF SHEET METAL BLANKS

BACKGROUND OF THE INVENTION

1. Field of the Invention

The present invention relates to a conveyer apparatus for the transport of sheet metal blanks from a cutter which produces sheet metal blanks in side-by-side rows to the magazine of a can welding machine.

2. Description of the Prior Art

A can welding apparatus continuously produces cans in a quick succession. Therefore, its magazine must be replenished continuously. The sheet metal blanks are produced by a cutter and must be filled into the magazine. Until now, for instance, a robot has been used for this procedure, which robot can hold and transport the sheet metal blanks by means of a suction force. Further known is also the use of a high-speed travelling conveyer belt between the cutter and the magazine. Due to the large number of sheet metal blanks per time unit which must be produced and simultaneously used up in the welding apparatus, the individual transporting of the sheet metal blanks is quite subject to break-downs. Furthermore, if the cans are additionally to be printed, for instance regarding the foodstuff content, a cutting of the printed sheet metal webs by means of the cutter at the one hand and the handling of the sheet metal blanks in an existing can welding apparatus having a bending machine for the producing the shape of the can at the other hand demand a turning over of the sheet metal blanks between the cutter and the magazine of the can welding apparatus, which can hardly be done any longer at a reasonable expenditure in case of the above mentioned individual transporting of the sheet metal blanks or other known machines.

SUMMARY OF THE INVENTION

It is, therefore, a general object of the invention to provide a conveyer apparatus for the above mentioned operation which is capable of operating at a high performance and without any break-downs and by means of which additionally the sheet metal blanks can be turned-over between the cutter and the magazine if such is needed.

A further object is to produce a conveyer apparatus which comprises a row of depositing receptacles arranged adjacent the cutter in a row extending along the cutter and intended each for receiving at least one sheet metal blank; a pair of conveyer chains having dogs which conveyer chains are movable under mentioned depositing receptacles and in a direction which extends perpendicularly to the direction in which the sheet metal blanks are leaving the cutter, which conveyer chains are operative to transport the sheet metal blanks which are engageable in said depositing receptacles at their side and to collect same by a sliding thereof over each other from one to the next depositing receptacle for producing a pile of sheet metal blanks on a transport surface adjacent the last depositing receptacle, which transport surface is designed as a slideway leading to a point above the magazine of the can welding apparatus and having a conveying means allocated thereto and which includes pawls which are movable in slots of the slideway and are intended for a pushing on of one respective sheet metal blank pile.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF PREFERRED EMBODIMENT

Figure 1:
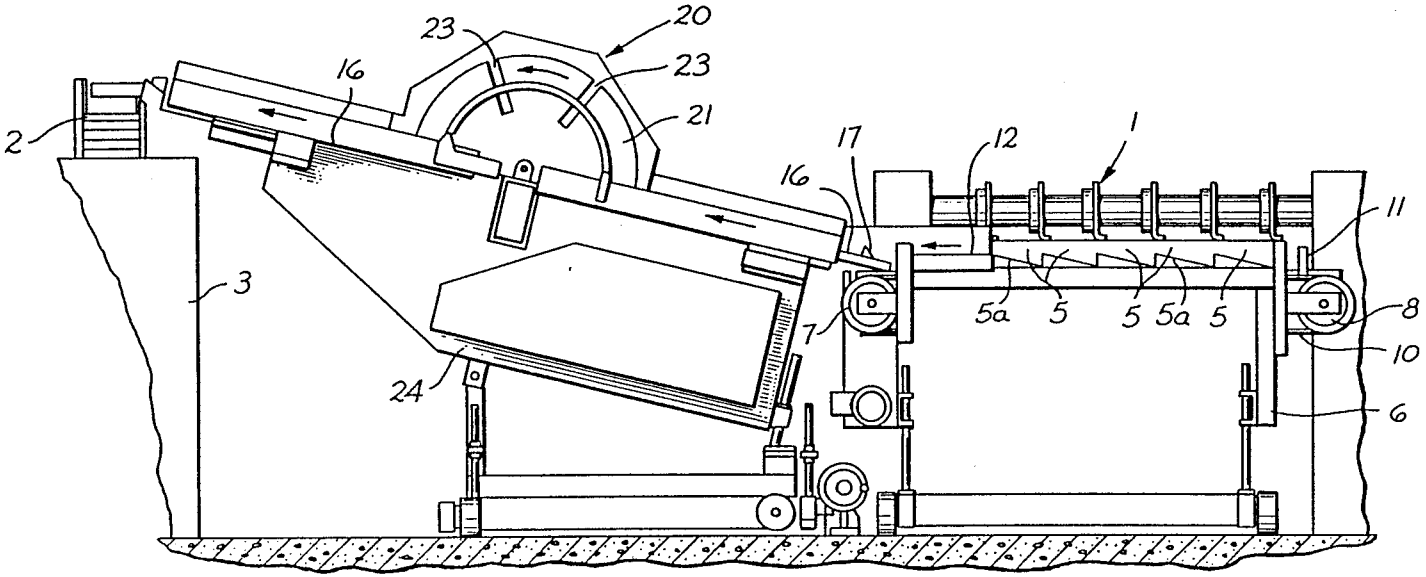
FIG. 1 is a schematic side view of a conveyer apparatus.
Figure 2:
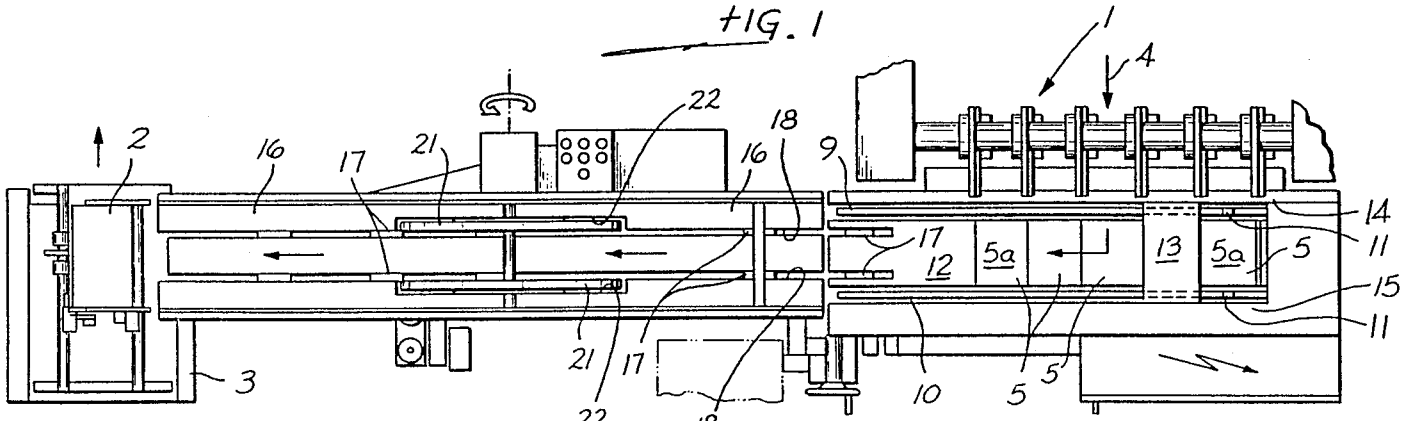
FIG. 2 is a schematic top view of the conveyer apparatus illustrated in FIG. 1.

The conveyer apparatus interconnects a cutter 1 and a magazine 2, which latter is part of a not particularly illustrated can welding apparatus 3. The cutter 1 produces substantially rectangular sheet metal blanks for can bodies in five adjacent rows whereby the sheet metal is fed to the cutter 1 in the direction of the arrow 4 in FIG. 2. The sheet metal blanks arrive thereafter in five depositing receptacles 5 arranged mutually adjacent in one row and located on top of a frame 6 which supports at its left and right end guide wheels 7 and 8 for two mutually parallel conveyer chains 9 and 10. Dogs 11 are mounted to both conveyer chains. These dogs, during the movement of the conveyer chains 9 leading from the right to the left on the illustration in the drawing, grip the sheet metal blanks which have been deposited in the receptacles 5 at their rear edge and push the blanks further, and specifically such, that the sheet metal blanks located in the depositing receptacle 5 located furthest to the right hand side and which are firstly engaged by dogs are pushed over to the adjacent depositing receptacle 5 to the left and that thereafter all sheet metal blanks of this latter receptacle are transported into the further adjoining receptacle etc., such to collect the sheet metal blanks and to form a pile on a transport surface or plane adjoining the last depositing receptacle 5. For this reason the receptacles 5 have each a bottom surface 5*a* rising slanted in the direction of transport, such as can be seen in FIG. 1, in order to allow the sheet metal blanks to be pushed over each other from the one to the next depositing receptacle. For sake of a clear illustration FIG. 2 shows a sheet metal blank 13 located in the second receptacle from the right hand end such to make it clear that the bottom surface 5*a* of the depositing receptacle 5 is narrower than the sheet metal blank 13, such to guarantee that the dogs 11 of the conveyer chain 10 can move at the opposite sides between the bottom surface 5*a* and a respective sidewall 14 and 15, respectively belonging to the frame and between which the sheet metal blanks are guided when being pushed over each other, in order to allow the dogs to grip the sheet metal blanks at their rear edge.

After a pile of sheet metal blanks has been formed on the transport surface 12 such pile will be pushed by means of the conveyer chains 9 and 10 and by the dogs 11 still somewhat further to the left such to allow a further conveyer means to take this pile over at a slanted rising slideway 16 adjoining at the left side and which extends upto the front of the magazine 2 of the can welding apparatus 3, which further conveyer comprises pairs of pawls 17 located at a distance parallel aside of each other. These pawls 17 move in two parallel slots 18 in the slideway 16 and are coupled to a driving device extending along the slideway and not particularly illustrated in the drawing, which driving device is moved to oscillate in a timed fashion such that the pawls 17 travel always only along a predetermined path section. The pawls 17 which are kept upright by a spring force are urged down when they move back under the pile of sheet metal blanks which they just before have pushed further on. A plurality of pairs of pawls 17 are located within the slideway 16 of which every one pair moves one pile further. Regarding the passing on of the pile from the conveyer chains 9 and 10 to the pawl conveyer means these two conveyers cross each other with regard to the ends of the conveyer chains and of the end of the slots 18, for which reason the latter are arranged further inwards with respect to the conveyer chains 9 and 10.

In case the sheet metal blanks have been printed they must be turned over for the further handling in the can welding apparatus 3. It is, therefore, advantageous to always turn a complete sheet metal pile over. To this end beginning at about halfway of the slideway 16 a turning-over apparatus 20 is provided which consists basically of two parallel disk wheels 21 which are rotatably supported and move rotatingly in slots 22 formed adjacent the slots 18. The disk wheels 21 comprise radially extending slots 23 into which a respective pile of sheet metal piles is pushed when the disk wheels 21 are at rest whereafter the disk wheels 21 are rotated such that the entire pile has been turned over when the radial slot 23 is located again over the slideway 16 but now at the opposite side relative to the turn-over device. The pile is thereafter taken over by the pawls 17 located at that location and transported further such to finally arrive in the magazine 2. The conveyer apparatus can, however, also be used without this turning-over apparatus in case a turning over of the pile of sheet metal blanks is not necessary whereby the rest of the principle of transport remains unchanged. The slideway 16 including the turning over apparatus 20 is mounted on a frame 24 which is mobile and has an adjustable height such to be in a position to adjust the apparatus to the location of the magazine.

We claim:

1. A conveyor apparatus for the transport of sheet metal blanks from a cutter which produces sheet metal blanks in side-by-side rows to the magazine of a can welding apparatus, comprising a row of depositing receptacles arranged adjacent the cutter in a row extending along the cutter and intended each for receiving at least one sheet metal blank; a pair of conveyor chains equipped with dogs and being movable under said depositing receptacles and in a direction which extends perpendicularly to the direction in which the sheet metal blanks exit from the cutter, which conveyor chains are operative to transport the sheet metal blanks which are engageable in said depositing receptacles at their side and to collect same by a sliding thereof over each other from one to the next depositing receptacle for producing a pile of sheet metal blanks on a transport surface adjacent the last depositing receptacle, said transport surface being designed as a slideway leading to a point above the magazine of the can welding apparatus and having a conveying means allocated thereto and which includes pawls which are movable in slots of the slideway and are intended for a pushing on of one respective sheet metal blank pile and a blank turning over apparatus located within the slideway between a forward slideway section adjacent and following said depositing receptacles and a rearward slideway section extending up to the magazine, which turning over apparatus is composed of two rotatably supported disk wheels including radially extending slots for a turning over of each sheet metal blank pile which has been slid thereinto, which disk wheels are movable in slots in said slideway adjacent the slots for the transporting pawls.

2. The conveyor apparatus of claim 1, in which said pawls are timed and oscillatingly movable in a forward and backward movement and are pushed down along the lower side of the sheet metal pile during their backward movement.

* * * * *